United States Patent [19]

Shames et al.

[11] 4,344,578

[45] Aug. 17, 1982

[54] HANDLED SPRAY

[76] Inventors: Sidney J. Shames, 57 Holly Pl., Briarcliff Manor, N.Y. 10510; Harold Shames, 5 Agnes Cir., Ardsley, N.Y. 10502

[21] Appl. No.: 210,310

[22] Filed: Nov. 25, 1980

[51] Int. Cl.[3] ..... B05B 1/30

[52] U.S. Cl. ..... 239/583; 239/530

[58] Field of Search ..... 239/456, 459, 525, 526, 239/530, 541, 562, 569, 583, 586; 251/245, 350, 353, 354

[56] References Cited

U.S. PATENT DOCUMENTS

| | | | |
|---|---|---|---|
| 2,657,098 | 10/1953 | Strahman | 239/459 |
| 2,937,813 | 5/1960 | Rinkewich | 239/459 |
| 3,128,048 | 4/1964 | Denure | 239/562 X |
| 3,498,546 | 3/1970 | Logan et al. | 239/583 |
| 3,524,593 | 8/1970 | Buckley et al. | 239/583 |
| 3,711,028 | 1/1973 | Hengesbach | 239/530 X |

*Primary Examiner*—Johnny D. Cherry
*Attorney, Agent, or Firm*—Norman Lettvin

[57] ABSTRACT

A handled spray with a lever for controlling flow therefrom is formed principally from molded parts, and with a spring that normally restores a flow control valve to its closed, or no flow, position. The discharge end of the spray body includes a cup-shaped closure with flow apertures therethrough. The cup-shaped closure cooperates with a ring-shaped insert shaped and arranged to provide for centering, and to support thereon a pair of concentric seals one of which provides a seal for the spray body, and the other seal providing a seal seat for the spring biased valve member that is selectively movable by the spray's handle to a position at which flow occurs. The valve member and handle are interconnected and assembled through a laterally opening recess, defined at the upstream end of the valve member, and telescopically receiving thereinto a laterally elongated knuckle formed integrally on the handle. The assemblage of valve member and handle is maintained against inadvertent separation by the bias of the spring holding the parts in a recess defined between flanges formed integrally on the spray body. The spray body is further shaped to provide a fulcrum for the lever.

9 Claims, 4 Drawing Figures

FIG. 1
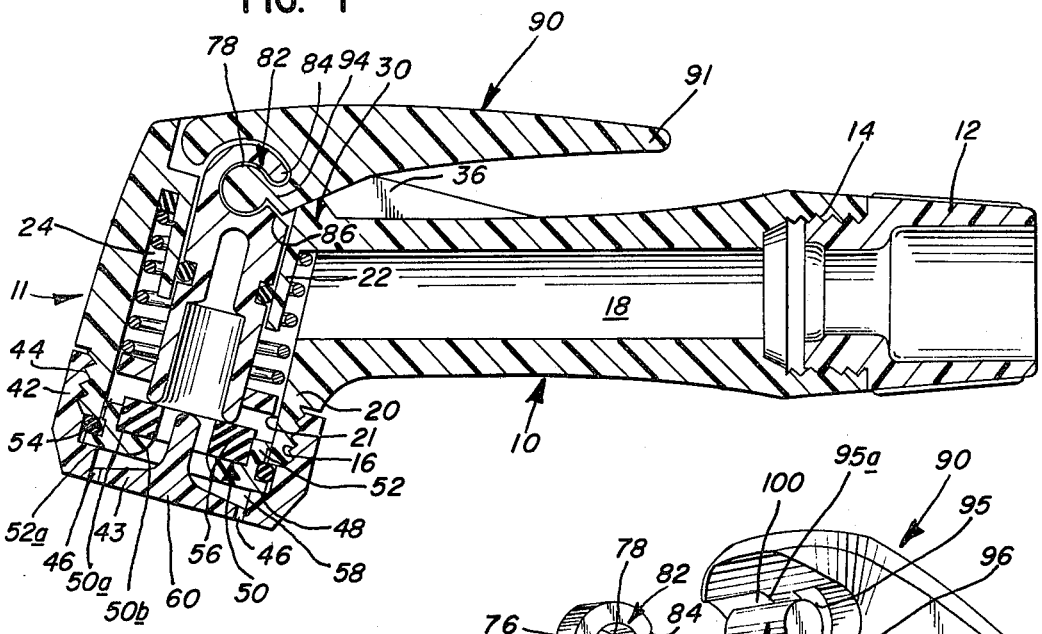
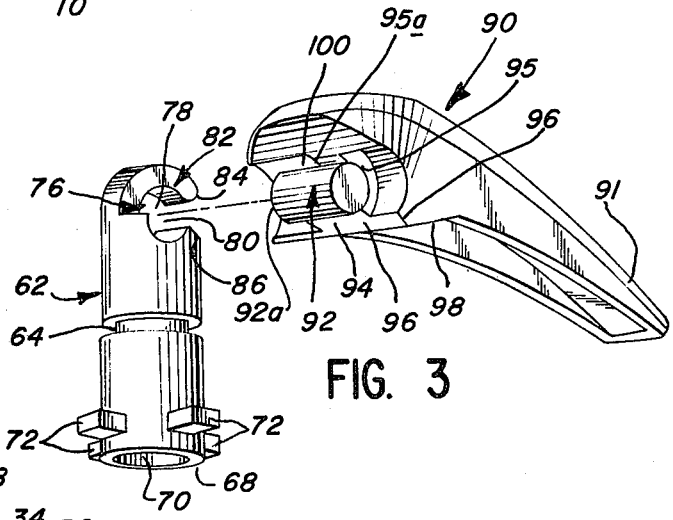
FIG. 3
FIG. 2
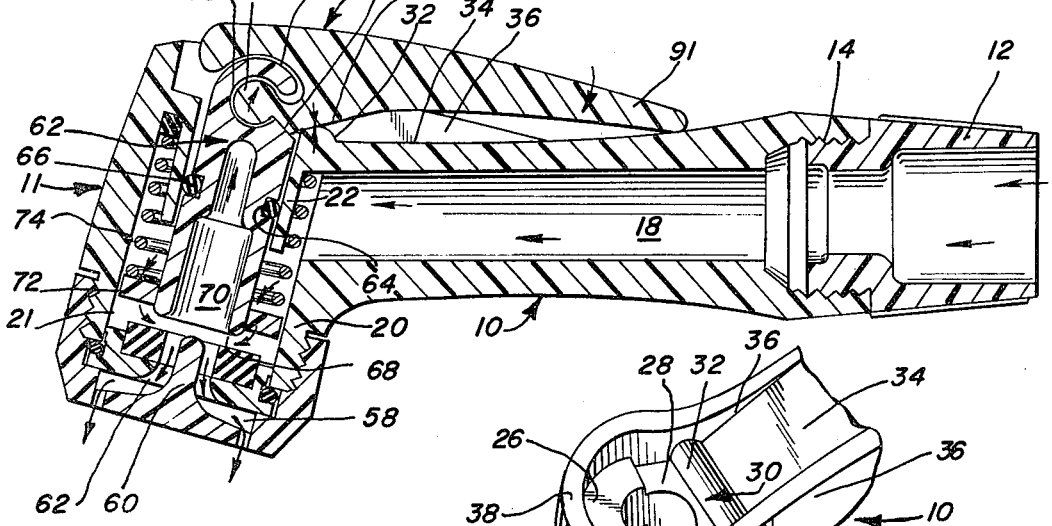
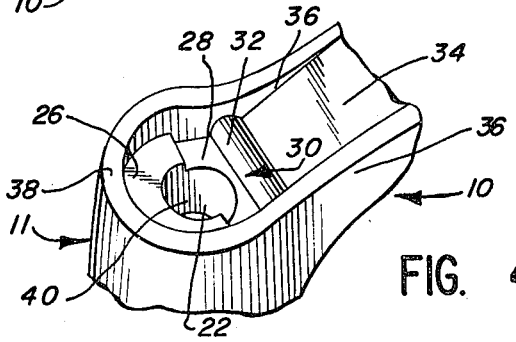
FIG. 4

HANDLED SPRAY

FIELD OF THE INVENTION

This invention relates to a handled spray, and more particularly relates to such a spray characterized by low cost construction and assembly, reliability of operation, and principally using molded plastic parts.

BACKGROUND OF THE INVENTION

It is known to provide a hand-held, lever-controlled, sink or bath appliance for providing a shower like spray therefrom, as disclosed in U.S. Pat. Nos. 3,498,546 and 3,637,143.

In the sink appliance construction disclosed in U.S. Pat. No. 3,498,546 water pressure must be utilized to aid in closing the valve, while the lever for opening the valve is of the second class and requires the valve element to be depressed to effect onset of flow, and with a restoring spring for the valve element being located downstream of the valve seat. The location of the restoring spring poses problems for servicing by inexperienced persons such as many homeowners.

In the bath appliance construction disclosed in U.S. Pat. No. 3,637,143 the valve for control of flow of liquid from the appliance is spaced a substantial distance from the discharge head, resulting in additional expense because of amount of material used in the appliance and cost of assembly. Also, excess water tends to dwell in the appliance downstream of the valve after flow has been cut off.

Thus, it is one object of this invention to provide an inexpensive construction for a hand-held, lever-controlled, bath appliance wherein the flow control valve therefor is located in the discharge head of the appliance, wherein the lever is of the first class, the restoring spring is upstream of the valve seat, and the lever and hollow handle of the appliance so cooperate with assembly of the flow-control valve member as to provide for economy of construction and reliability of operation.

A further object of this invention is to provide a hand-held spray appliance that is more readily serviceable when the need arises to clean the water borne debris from the spray apertures of the appliance.

Another object of this invention is to provide a construction for the discharge head of a hand-held spray appliance that provides effective sealing during flow cut-off and which eliminates dwell of any substantial amount of water in the appliance downstream of the flow valve therefor.

Further objects and advantages will become known, or will be apparent to one skilled in the art, by reference to the following specifications and drawings.

BRIEF SUMMARY OF THE INVENTION

A hand-held spray appliance is provided with a flow control valve therefor in the spray head of the appliance. The valve includes a flow control spool that reciprocates against an upstream spring between a raised open position and a depressed closed position of the valve, with said spring normally biasing the seal end of the control spool downstream toward a closed valve position, and a lever being shaped and arranged relative to the opposite end of the spool for interconnection therewith, without other fastening means, whereby assembly costs are reduced. The spray head includes a removable, molded cup-shaped closure that provides jetforming apertures, and carrying therein a removable insert and a pair of seals, one of which is positioned to cooperate with the seal end of the control spool when the control valve is closed. The removable cup-shaped closure and its contents permit easy servicing and cleaning of the operative portions of the spray head without disturbing the restoring spring.

BRIEF DESCRIPTION OF THE DRAWINGS

FIG. 1 is a longitudinal cross-sectional view of a hand-held spray appliance showing the invention of this application with the valve of the appliance in a closed position;

FIG. 2 is a view corresponding to FIG. 1 but showing the lever control depressed so as to open the flow valve and illustrating, by arrows, the flow of liquid through the spray appliance;

FIG. 3 is an exploded perspective view of the spool and lever portion of the spray appliance shown in FIGS. 1 and 2, and further illustrating by broken axially-projected line the projected lateral movement of the lever and its pivot knuckle for effecting the operative connection between said spool and lever that is seen in FIGS. 1 and 2; and FIG. 4 is a fragmentary perspective view of the upper forward portion of the handle portion of the spray appliance, showing both the upper end of the bore which receives therein the upper end of the spool, and the adjacent channel structure and fulcrum defined on the handle for cooperation with the lever, when the lever and spool are functioning as shown by FIGS. 1 and 2.

DESCRIPTION OF THE PREFERRED FORM

Referring now to the drawings, the hand-held spray is shown as including an elongated tubular handle, generally 10, formed integral with a spray head 11 at the discharge end thereof. The opposite end of handle 10 is adapted to be detachably secured to the discharge end of a nipple 12 that connects, or is attached, to a flexible liquid supply hose (not shown).

The handle 10 is a molded body formed at its upstream end with female threads 14, at its downstream end with male threaded portion 16, and an elongated longitudinal flow channel 18 therethrough. The spray head 11 is an elongated tubular portion that is angled with respect to the longitudinal axis of flow channel 18 and is shaped to provide an outer, downstream, sleeve 20 and a concentric inner, upstream, sleeve 22. Inner sleeve 22 is spaced radially inwardly of the inner wall 21 of the outer sleeve 20 to define an arcuate recess 24 between said inner sleeve 22 and the inner wall 21 of the outer sleeve 20.

The downstream end of the outer sleeve 20 of spray head 11 is male threaded to provide the male threaded end 16 of the handle 10. The opposite end of spray head 11 is recessed, as seen in FIGS. 1 and 2 but best seen in FIG. 4, and is shaped to provide within the recess an upper semi-circular shelf 26 and an opposed lower semi-circular shelf 28, that together bound a bore 40, and a transverse fulcrum 30. The fulcrum 30 has a rounded or convex, fulcrum surface 32. The fulcrum 30 projects above and separates adjacent lower shelf 28 and adjacent, generally planar handle surface 34. The handle 10 is further shaped to provide a pair of parallel, upstanding flanges 36 that are angled relative to the body of handle 10, as seen in FIGS. 1 and 2, and which laterally bound planar surface 34 and project forwardly of the fulcrum 30 to merge with the ends of a semi-circular upstanding wall 38 that surrounds and extends above upper shelf 26, as clearly seen in FIG. 4. The sleeve 22 surrounds the axially elongated bore 40 seen in FIGS. 1, 2 and 4.

On the downstream end of outer sleeve 20 there is provided a cup-shaped closure 42, which is female threaded at 44 and adapted for screw connection to the male threaded portion 16 on the handle 10. The closure 42 has a bottom wall 43 that has a plurality of discreet, spaced apertures 46 extending therethrough, arranged in a circle to provide a circular spray from the spray head 11. In the actual preferred construction there are 16 spaced apertures whose walls are appropriately angled downstream, as is known in the art, to both form the spray jets and to direct the spray jets in an outwardly directed conical pattern.

Spaced above the cup's bottom wall 43 there is provided in the inner wall of the closure 42 an annular support shoulder, or shelf 48, located radially inwardly of an axial projection of the female threads 44. Supported on shoulder 48 is an annular ring-shaped insert 50. The insert 50 has extending upstream therefrom a centering ring 52 which is adapted to aid in forming an outer recess **52*a* for receiving an outer O-ring seal 54. The inner periphery of the centering ring 52 provides a recess for receiving and seating therein a relatively thick, ring-like, inner, seal body 56. The insert 50 provides an upstream annular support surface 50*a* for supporting the seal body 56. The downstream innermost edge of the insert 50 is chamfered, or preferably rounded at 50*b*** to provide what is best termed a downstream enlarging bell shape.

The downstream transverse face of insert 50 is spaced above the upstream side of the bottom 43 of the cup-shaped closure 42 to define therebetween a flow chamber 58. The central portion of the bottom wall 43 of closure 42 is shaped to provide an upstream extending central stud 60 which has flared surfaces which merge with the upstream side of wall 43. The stud 60 extends upstream through insert 50 to a point just upstream of seal body 56, with stud 60 spaced from the inner edges of insert 50 and body 56 to provide a bell-shaped annular flow passageway 62 communicating flow from a point upstream of body 56 to chamber 58 and through discharge apertures 46.

With the cup-shaped member 42 secured in position as seen in FIGS. 1 and 2, the O-ring outer seal 54 is held and engaged between spaced concentric portions of the insert 50 and surrounding cylindrical portions of the cup-shaped member 42, and is engaged axially between the outermost portion of insert 50 and the terminal edge of sleeve 20, thereby effecting sealing engagement with O-ring seal 54 on four sides.

The inner seal body 56 is preferably of a size to project upstream of the adjacent upstream portion of centering ring 52. The centering ring 52 is of a size to slidably enter adjacent the inner wall 21 of sleeve 20.

For the "on" and "off" control of flow through the spray head 11, there is provided an elongated flow-control spool member 62, a central portion of which is slidably positioned for reciprocation thereof in bore 40. A portion intermediate the ends of said central portion of elongated control spool 62 is recessed at 64 to provide an annular groove for receiving thereinto an O-ring seal 66 that is of a size for effecting a slidable seal with the inner wall of the upstream sleeve 22 as the spool member 62 is reciprocated in bore 40. The axial length of sleeve 22 is such as to provide that there is an effective sealing by O-ring 66 for all positions of movement of the spool 62. The lower, or downstream, edge 68 of the control spool 62 is rounded, as best seen in FIGS. 1 and 2, and is so dimensioned as to sealingly engage along a continuous seal line with the upper face of the seal body 56 when the spool 62 is in the position shown in FIG. 1. Inwardly of the seal edge 68 the spool 62 is recessed as shown at 70.

The spool 62 is provided adjacent the downstream end thereof with a plurality of circumferentially spaced abutments 72 which serve as a seat for the lower end of a strong, compression coil spring 74. The abutments 72 are spaced upstream of the edge 68 of spool 62 so that abutments 72 will not engage inner seal 56 in the FIG. 1 position. The compression coil spring 74 is of a size to surround the upstream sleeve 22 and to be spaced between sleeve 22 and the inner wall 21 of downstream sleeve 20.

The upstream end of spool 62 is shaped to provide a pivot connection means, generally 76, specifically designed to cooperate with connection means provided on an actuating lever that is hereinafter described. The connection means on spool 62 includes a laterally opening cylindrical recess 78, whose axis is transverse to the axis of bore 40 in which the spool 62 reciprocates. The recess 78 is bounded at one end by wall 80 and bounded along its uppermost portion by a hook-shaped element 82 with an inner cylindrical contour, as shown, and with element 82 having a terminus 84 that is spaced from a bevelled abutment edge 86 provided on the spool 62. The hook-shaped element 82 has a lateral width that is less than the diameter of spool 62 so that the planar lateral face of hook 82 lies substantially in a diametrical plane through the longitudinal axis of spool 62.

The lever for cooperation with spool 62 is generally indicated at 90, and is a member that is elongated in a direction parallel to the axial length of handle 10, with a lateral width selected to closely fit between the parallel flanges 36 defined on handle 10. Lever 90 is an elongated molded body that is shaped to provide a thumb actuated end 91 and adjacent the other end thereof an elongated cylindrical knuckle 92 whose axis extends laterally, the axis being indicated by the broken line in FIG. 3. The laterally elongated knuckle 92 is supported from a laterally elongated connecting neck 94 that extends along the length of the knuckle, terminating in the arcuate end wall 95. Surface 96 of lever 90 is shaped to abut the abutment surface 86 on spool 62 when the lever is in one extreme position that is shown in FIG. 2. The abutment surfaces 96 and 86 provide one limit for the relative movement between spool 62 and lever 90. Lever 90 is shaped to provide intermediate end 91 and knuckle 92 an inner surface 98 which abuts and engages the rounded surface 32 of the fulcrum 30 to provide a lever of the first class. The knuckle 92 is further bounded by a laterally elongated arcuate recess 100 into which the hook 82 extends and within which arcuate hook 82 moves arcuately.

When the parts are assembled, the strong spring 74 biases the spool member downwardly to the position in FIG. 1 where the rounded edge 68 at the lower end of spool 62 engages the seal body 56 to effect a water-tight seal against pressure of water in channel 18. In that position, the spool 62 is in its furthermost downstream position, and the lever end 91 is swung to the "up" position illustated in FIG. 1. At this position there is no flow. In order to initiate flow, the user manually depresses the rearwardly extending end portion 91 of lever 90 to the position shown in FIG. 2, or some intermediate position between FIG. 1 and FIG. 2. During that operation the lever 90 pivots about fulcrum engaging surfaces 98–32 to move knuckle 92 arcuately about fulcrum 30 and to move the spool 62 axially thereof away from the seal body 56, permitting water to flow as shown by the arrows in FIG. 2. The movement of lever 90 is limited by the rearmost end portion 91 of the lever abutting the handle 10. Upon release of manual pressure, the spring 74 automatically biases the parts to the closed valve position of FIG. 1.

To assemble the construction shown, the cup-shaped member 42 and parts 50 and 56 contained therein are removed. The spool 62 and spring 74 are inserted axially through the downstream sleeve 20. The spring 74 is compressed by a force until the upper end of the spool projects above shelf 28 to a position where lateral recess 80 of the spool 62 is exposed above the upper edge of adjacent flange 36. Then the lever 90 is moved laterally relative to the spool so that the free end 92*a* of knuckle 92 enters laterally into recess 80 and below hook 82 until the free lateral edge of hook 82 engages or is adjacent edge 95*a* of wall 95 that interconnects knuckle 92 to the lever 90. Then, upon release of the force that compresses spring 74, the spring 74 will expand to pull the knuckle 92 and the knuckle end of lever 90 downwardly to a position where it enters the recess defined between the spaced flanges 36, and to the position seen in FIGS. 1 and 2, and thereafter the parts cannot be inadvertently separated by any normal force applied to lever 90.

While a particular embodiment of this invention has been shown and described, it will be obvious to persons skilled in the art that various changes and modifications may be made therein without departing from the spirit and scope of the invention and, therefore, it is intended in the appended claims to cover all such changes and modifications which fall within the true spirit and scope of the invention.

What is claimed is:

1. In a handled spray that is provided with a lever operated flow control, the improvement comprising, in combination:

an elongated tubular molded body shaped to define thereon upstream and downstream concentric sleeves, with molded thread attachment means on said downstream sleeve;

a molded elongated flow control spool member shaped at its upstream end to provide means for cooperation with said lever, and shaped at its downstream terminus to provide thereon an annular rigid seal element;

an O-ring seal carried on the flow control spool member spaced downstream of said means for cooperation with said lever for effecting a slidable seal with the inner wall of said upstream sleeve;

abutment means on said flow control spool member adjacent to but spaced upstream of said downstream terminus of said spool member and extending radially outwardly of a downstream projection of the upstream sleeve;

an elongated compression coil spring surrounding the upstream sleeve with one end in force transfer relation to said molded body and the other end engaging said abutment means on the flow control spool member to normally bias said spool member downstream;

a cup-shaped closure for the discharge end of the molded body shaped to provide in the cup's bottom wall a plurality of spaced, discrete, jet-forming apertures, and attachment means on the cup's sidewall adapted for selective connection to said attachment means on the downstream sleeve of said molded body;

an annular rigid insert carried in said cup-shaped closure and spaced from said cup's bottom wall to provide a radially enlarged flow chamber whose inlet is the central opening of the annular insert and whose outlets are said plurality of jet-forming apertures; and said annular insert carrying a pair of concentric seals, the outer one of said concentric seals being positioned to effect resilient sealing engagement between the insert and the cup-shaped closure and between said insert and the downstream terminus of the molded body when the closure is secured to the molded body, and the inner one of said concentric seals being an annular body positioned to receive thereagainst, in sealing engagement, the downstream edge of the spool member under the bias of said coil spring.

2. A handled spray construction as in claim 1 wherein the upstream side of said bottom wall of the cupshaped closure is shaped to provide an upstream extending central stud which projects axially upstream a distance sufficient to extend into the central opening of said annular rigid insert.

3. A construction as in claim 2 wherein surfaces of the central stud and the downstream surface of the central opening of the annular insert are curved to provide therebetween a bell-shaped, annular, flow passageway upstream of said radially enlarged flow chamber.

4. A construction as in claim 1 wherein the central portion of the downstream end of the spool member is recessed.

5. A construction as in claim 1 wherein the lever of the handled spray is a first class lever and the tubular body is shaped to provide thereon a fulcrum against which a portion of the lever abuts for all positions of movement of the flow-control spool member.

6. A construction as in claim 5 wherein said fulcrum is a transverse bead formed on the tubular molded body and shaped to provide a smoothly rounded fulcrum surface.

7. A construction as in claim 1 wherein the end of the flow-control spool member which connects to the lever, and the lever, are both constructed and arranged to provide for interconnection therebetween by relative assembly motion of the parts in a direction transverse to the longitudinal axis of the spool member.

8. A construction as in claim 7 wherein the connecting portions of the flow-control spool member and lever are laterally apertured, to permit lateral assembly interconnection therebetween and only when the spool member has been forced axially against the compression coil spring to an extent where the lateral aperture on the flow-control spool member is laterally exposed relative to the laterally projected confines of the tubular molded body.

9. A construction as in claim 8 wherein the tubular molded body is provided with spaced parallel ears thereon defining a recess within which said lever-connecting portion of the spool member moves and into which a portion of the lever will be drawn under the bias of the coil spring, after the lever is laterally assembled to the spool member.

* * * * *